US009612070B2

(12) United States Patent
Hatch

(10) Patent No.: US 9,612,070 B2
(45) Date of Patent: Apr. 4, 2017

(54) CARTRIDGE LOADING DEVICE

(71) Applicant: Larry P. Hatch, Vail, AZ (US)

(72) Inventor: Larry P. Hatch, Vail, AZ (US)

( * ) Notice: Subject to any disclaimer, the term of this patent is extended or adjusted under 35 U.S.C. 154(b) by 0 days.

(21) Appl. No.: 14/933,835

(22) Filed: Nov. 5, 2015

(65) Prior Publication Data

US 2016/0202007 A1 Jul. 14, 2016

Related U.S. Application Data

(63) Continuation-in-part of application No. 14/088,117, filed on Nov. 22, 2013, now Pat. No. 9,182,185.

(51) Int. Cl.
*F41A 9/61* (2006.01)
*F41A 9/83* (2006.01)
*F41A 9/67* (2006.01)

(52) U.S. Cl.
CPC . *F41A 9/83* (2013.01); *F41A 9/67* (2013.01)

(58) Field of Classification Search
USPC ..... 42/87; 89/33.1
See application file for complete search history.

(56) References Cited

U.S. PATENT DOCUMENTS

| | | | |
|---|---|---|---|
| 4,739,572 | A | 4/1988 | Brandenburg |
| 4,939,862 | A | 7/1990 | Brandenburg et al. |
| 4,949,495 | A | 8/1990 | Mari |
| 5,301,449 | A | 4/1994 | Jackson |
| 6,754,987 | B1 | 6/2004 | Cheng et al. |
| 2009/0044440 | A1 | 2/2009 | Tal et al. |
| 2012/0192477 | A1 | 8/2012 | Kim |
| 2012/0222343 | A1 | 9/2012 | Kim |
| 2012/0255211 | A1 | 10/2012 | Kim |
| 2014/0109451 | A1 | 4/2014 | Beckman |

OTHER PUBLICATIONS

PCT/US2013/071521—International Preliminary Report on Patentability dated May 26, 2015.
PCT/US2013/071521—International Search Report and Written Opinion dated Mar. 26, 2014.

*Primary Examiner* — J. Woodrow Eldred
(74) *Attorney, Agent, or Firm* — Jiarong Lamiquiz; Quarles & Brady LLP

(57) ABSTRACT

An apparatus for loading cartridges into a firearm magazine, including a hopper for intake of one or more cartridges, a hopper slide attached to the hopper, a cassette attached to the hopper slide, and a frame for fixturing the apparatus.

20 Claims, 26 Drawing Sheets

CARTRIDGE LOADING DEVICE

CROSS REFERENCE TO RELATED APPLICATIONS

This Application is a Continuation-In-Part of a U.S. Non-Provisional application filed Nov. 22, 2013, and having Ser. No. 14/088,117, which is hereby incorporated herein by reference.

FIELD OF THE INVENTION

This invention relates to an apparatus, and method using that apparatus, to load cartridges, i.e., ammunition, into a firearm magazine.

BACKGROUND OF THE INVENTION

Conventional loading of detachable firearm magazines, sometimes incorrectly referred to as clips often require strength, dexterity, or both. It is often difficult to load more than a few magazines at a time by hand, because it often leads to sore fingers. Even currently available magazine "speed" loaders often require dexterity to line up the cartridges one by one in a machine, to then have to force the cartridges into the magazine by either pushing directly down, pulling on a handle to force the cartridges into the magazine, or to insert each cartridge into a finger operated machine one at a time to use leverage to help force them into the magazine.

It is often a time consuming and tiring event to line up and then force the cartridges into the magazine either by hand or with mechanical advantage. Often this leads to many people who may suffer from strength or dexterity issues from being able to enjoy the sport of shooting. Further even able-bodied people may avoid this recreational activity due to the time and hassle that is required to load enough removable magazines to make the experience worthwhile.

SUMMARY OF THE INVENTION

An apparatus for loading cartridges into a firearm magazine is disclosed to address the above recited problems. The apparatus comprises a funnel portion or a hopper for intake of one or more cartridges, a guide box or a hopper slide attached to the funnel portion, and a cassette attached to the guide box or the hopper slide. The apparatus is designed to align different types of firearm cartridges in proper positions to allow them to be disposed correctly into corresponding firearm magazines. In certain embodiments, the cassette is removable such that a cassette configured for a specific ammunition can be utilized. In certain embodiments, the hopper with adjustable disks can be configured to accommodate different types of firearm cartridges.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF THE PREFERRED EMBODIMENTS

This invention is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1A:
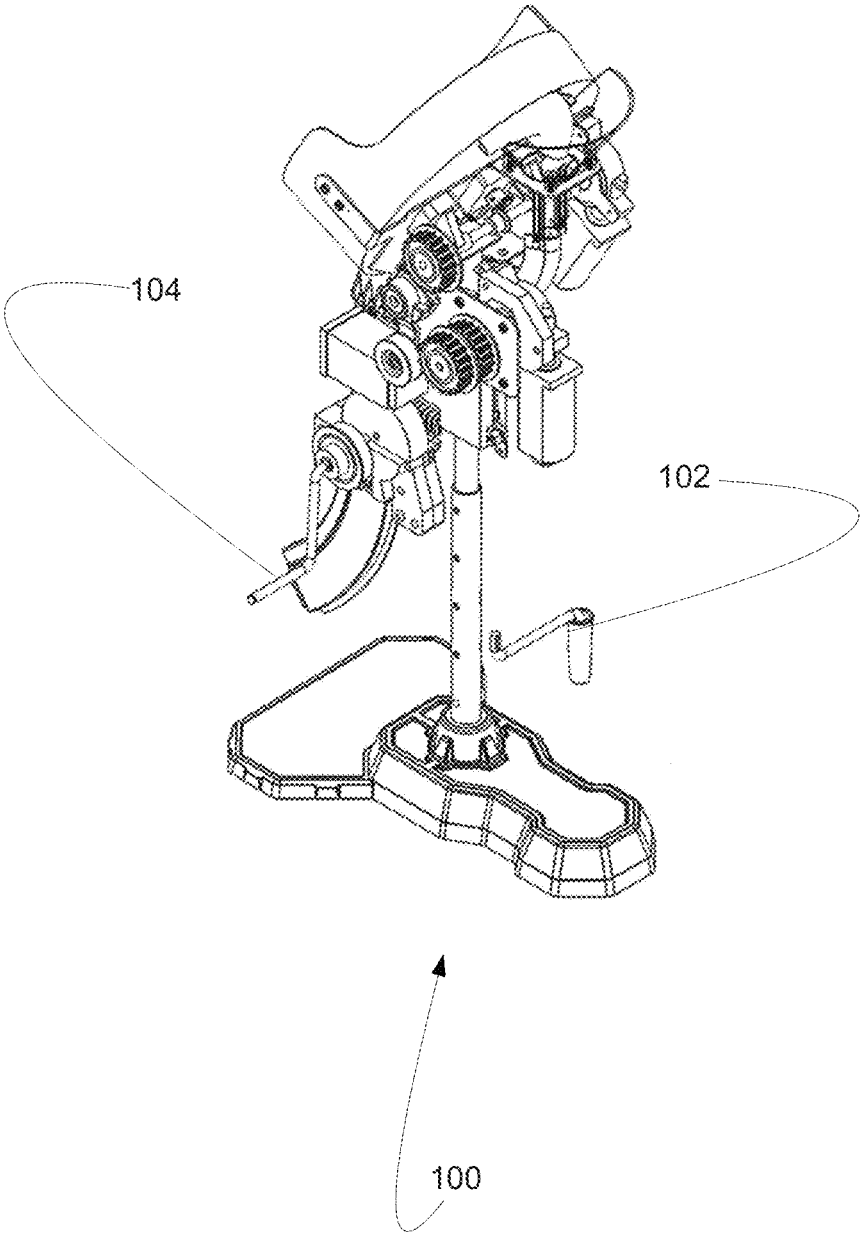
FIG. 1A illustrates a perspective view of Applicant's apparatus for loading cartridges into a firearm magazine.
Figure 1B:
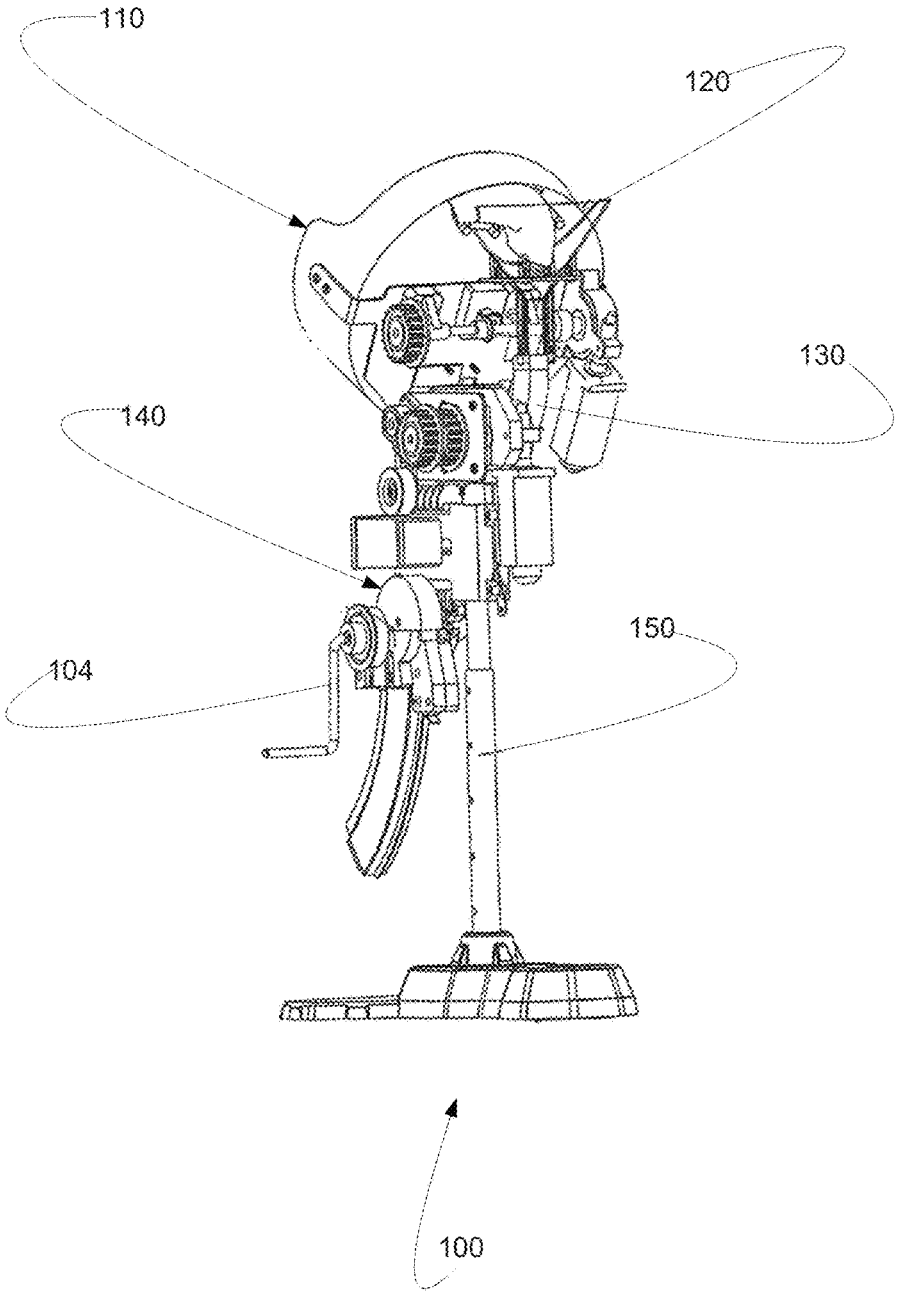
FIG. 1B illustrates another perspective view of Applicant's apparatus for loading cartridges into a firearm magazine.
Figure 1C:
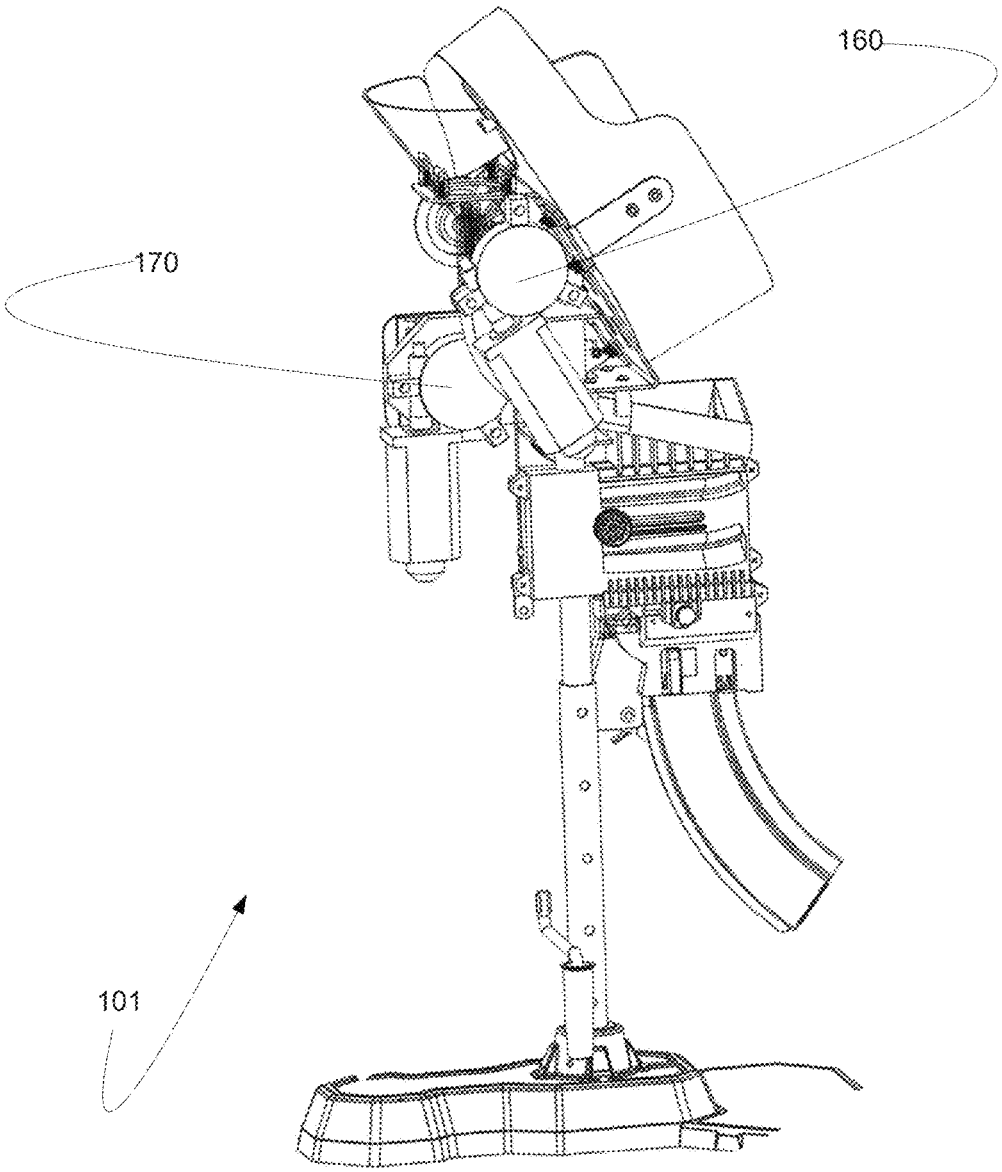
FIG. 1C illustrates a side view of Applicant's apparatus for loading cartridges into a firearm magazine.

Referring now to FIGS. 1A, 1B, and 1C, Applicant's magazine loading device 100 comprises a hopper 110 wherein cartridges, i.e., ammunition, can be loaded into detachable firearm magazines. In certain embodiments, hopper 110 can hold at least 200 cartridges. In certain embodiments, hopper 110 can hold more than 200 cartridges. Further, in certain embodiments, Applicant's magazine loading device 100 comprises a funnel 120 for firearm cartridges loading and a funnel slide 130 having a first end and a second end, wherein the first end is attached to the hopper 110, and wherein the send end is attached to a cassette 140.

FIG. 1B illustrates hopper 110, funnel 120, funnel slide 130, cassette 140, and stand 150. In certain embodiments, hopper 110 is configured to be operated by a motor. In certain embodiments, the hopper 110 can be operated by a hand crank 102 (note that hand crank 102 is not shown attached to hopper 110 in FIG. 1A.

FIG. 1C shows a first motor 160 operatively coupled to a rotatable disk disposed within the hopper 110, and a second motor 170 operatively coupled to the magazine 140.

Figure 2:
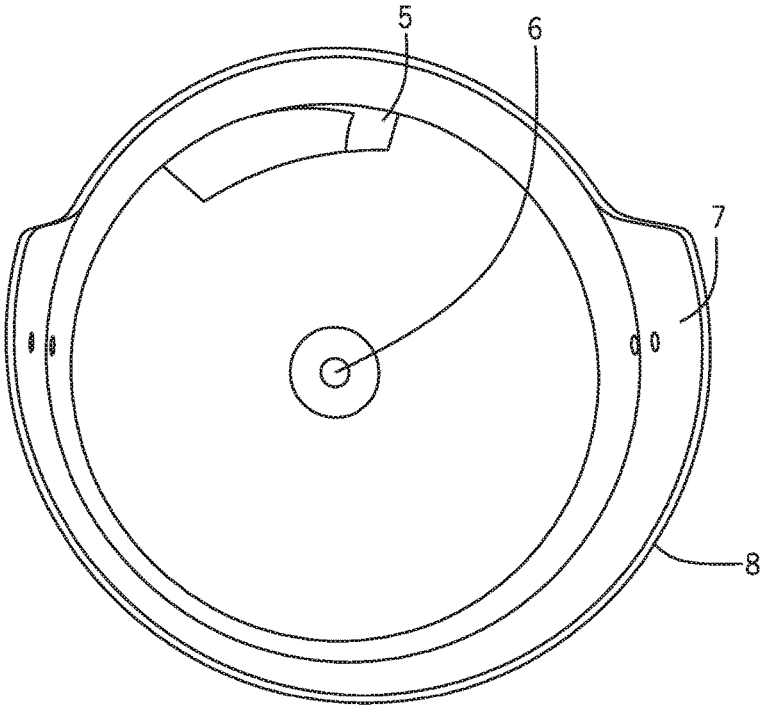
FIG. 2 is a top view of the hopper portion of FIG. 1B.

Referring to FIG. 2, hopper 110 comprises an outside shell 8, which is called a bucket. Referring to FIGS. 2, 4, 5, 6, 7, 8, and 9, a rotatable disk 6 is moveably disposed inside bucket 8, which aligns and moves the cartridges out of the hopper and into the funnel 120.

Figure 3:
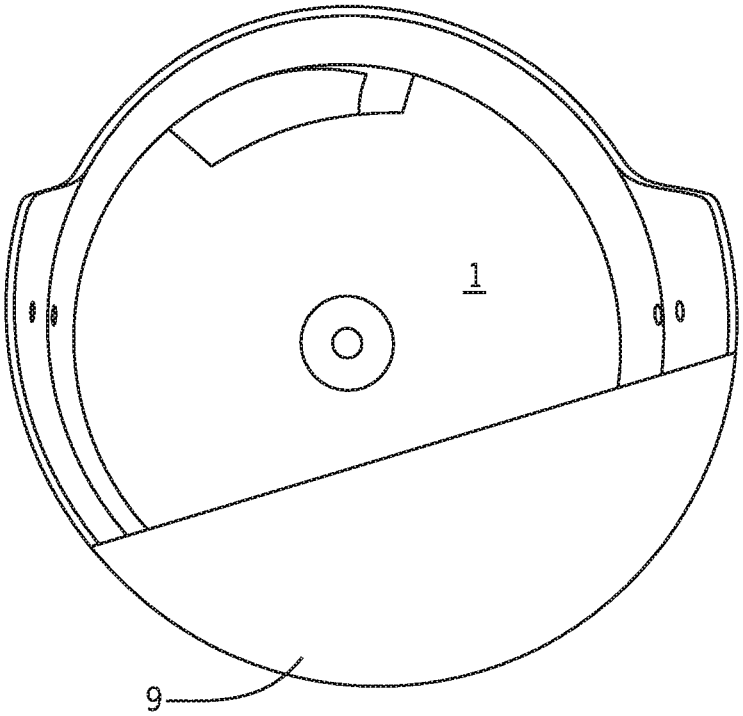
FIG. 3 is another top view of the hopper portion of FIG. 1B, with the addition of the cover plate portion of FIG. 1B.
Figure 4:
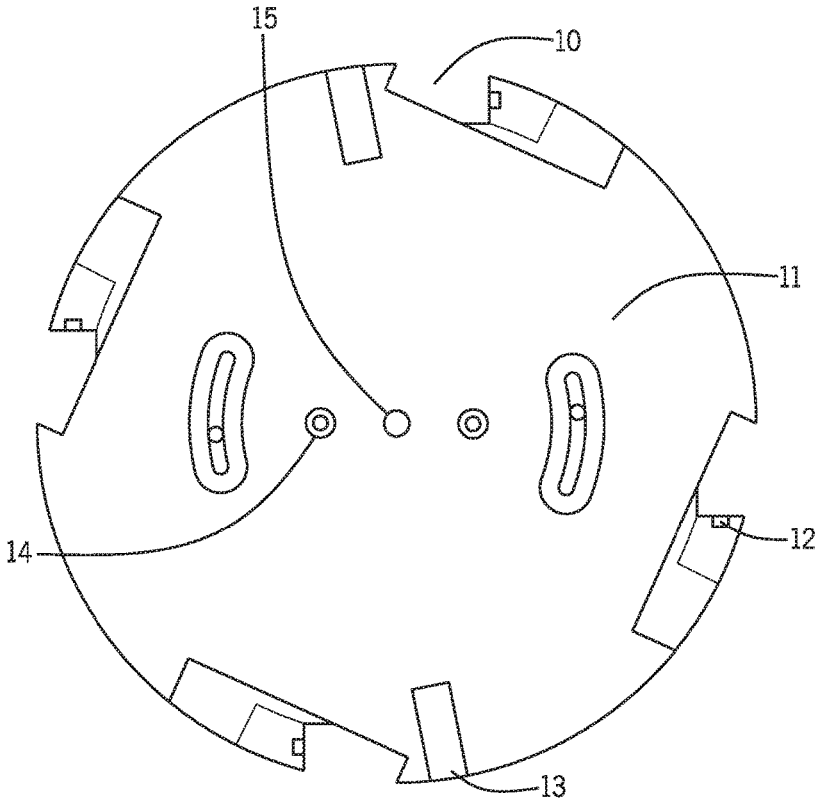
FIG. 4 is a top view of the adjustable disk portion of FIG. 1A, with two separate disks.
Figure 5:
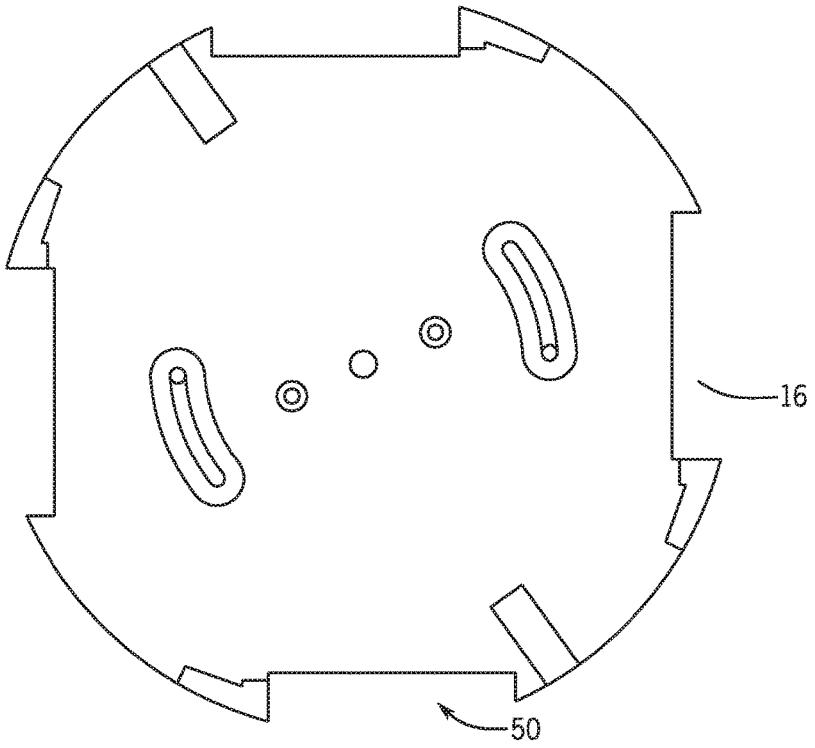
FIG. 5 illustrates another perspective of the adjustable disk portion of FIG. 1A, with two separate disks.
Figure 6:
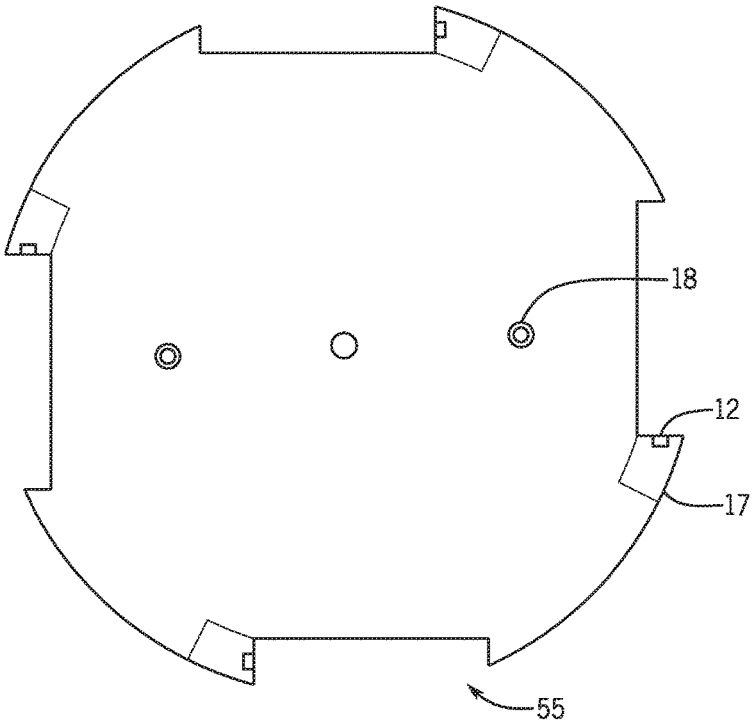
FIG. 6 is the top view of the bottom disk 55 of FIGS. 4 and 5.
Figure 7:
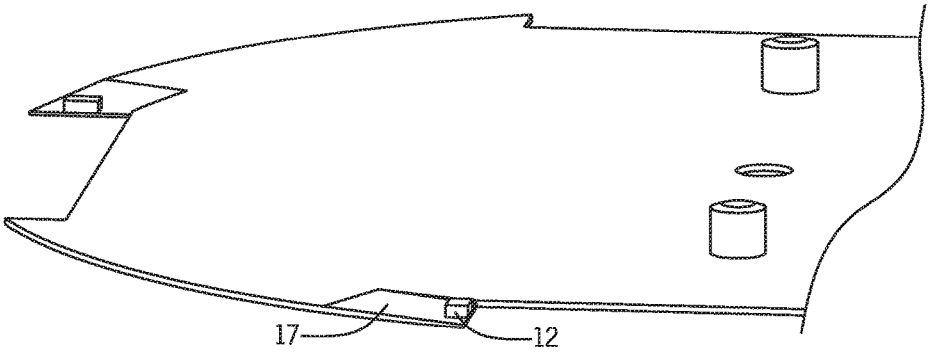
FIG. 7 illustrates the nub portion and the ramp portion of FIG. 6.
Figure 8:
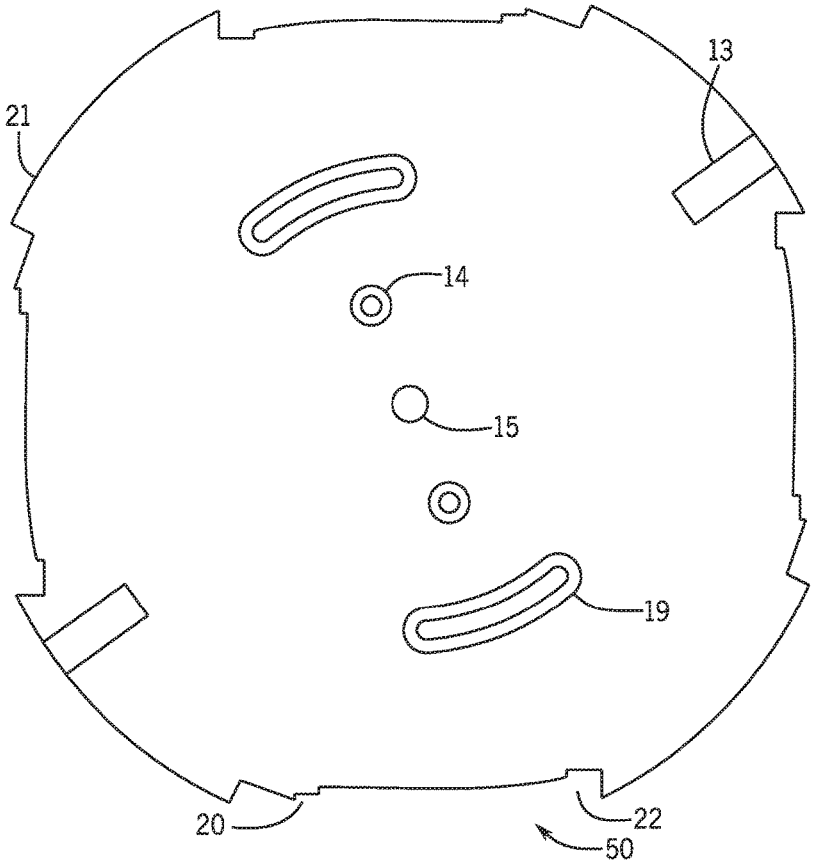
FIG. 8 is the top view of the top disk portion of FIGS. 4 and 5.

Referring to FIG. 3, a cover plate 9 is disposed over a portion of hopper 110, and is attached to the bucket 8 to retain the cartridges in the bucket while they are agitated by rotating disk 6.

Cassette 140 is configured to releasably fixture a firearm magazine to apparatus 100. Cassette 140 and moves cartridges from funnel slide 130 into an attached magazine. In certain embodiments, cassette 140 is operated by a hand crank. In certain embodiments, cassette 140 is operated by a motor 170 (FIG. 1C).

In certain embodiments, cassette 140 (FIGS. 1A, 1B, and 1C) is detachable from apparatus 100, which allows apparatus 100 to be used with multiple magazines, cartridge configurations, and cartridge calibers.

In certain embodiments, the apparatus 100 can utilize cartridge calibers from .380 auto to 308. In certain embodiments, apparatus 100 can load smaller caliber cartridges into a magazine, such as the 22 Long Rifle and other small rounds. In certain embodiments, apparatus 100 is configured to utilize larger caliber cartridges, such as shot gun cartridges and 50 caliber cartridges. In certain embodiments, cassette 140 is configured to releasably attach different types of pistol and rifle magazines.

Referring to FIG. 1B, hopper slide 130 is a conduit for aligned cartridges to be conveyed from a slot on the back of the hopper and disposed into the cassette. In certain embodiments, hopper slide 130 comprises a downwardly sloping slide. In certain embodiments, hopper slide 130 comprises a downwardly sloping tube. In certain embodiments, hopper slide 130 is positioned on a back portion of hopper 110.

Referring to FIG. 1B, a frame 150 of the magazine loading device allows for all parts of the invention to be held in a static relationship to one another. Further, frame 150 allows a user to configure the said device based on the user's preference and the size of the magazine to be loaded.

In certain embodiments, motor 170 (FIG. 1C) operates cassette 140 (FIG. 1B). In certain embodiments, a electronic control module (ECM), which consists of an input/output screen with various buttons or dials to allow the user to interface with the electronics of the machine, is situated such that it can connect to either the left or right hand side of the hopper depending on the users' preference.

In certain embodiments, the ECM allows for various inputs and outputs to display a number of cartridges the user wishes to load into a magazine and a number of cartridges that have already been loaded. In certain embodiments, the ECM enables counting and stores data that it processes. Further, in certain embodiments, the ECM is compatible with wireless technology, such as the use of WIFI and Bluetooth, to allow the user to employ another electronic device to interface with the machine. In addition, a sensor is placed in and on the cassette 140 (FIG. 1B) to allow exchanging of data with the ECM via a connector.

Referring again to FIG. 2, slot 5 allows a cartridge to fall out of hopper 110, and move into slide 130. An aperture formed in rotatable disk 6 facilitates connection of disk 6 to motor 160 or hand crank 102. Grommets 7 through which a screw connects hopper 110 and frame 150, wherein the corresponding grommets 7 are disposed on the opposing side of the bucket to connect the bucket to both sides of hopper 110. Grommets 8 are positioned at an angle to move the bucket up and down along the centerline of hopper 110 and used for the connection of cover plate 9. In certain embodiments, cover plate 9 (FIG. 3) attaches to hopper 110 at an angle to prevent unloaded cartridges from falling out of hopper 110.

Referring to FIGS. 4, 5, 6, and 8, in certain embodiments, the rotatable disk 6 comprises two individual disks, which are coupled together and can be adjusted to accommodate different sizes of cartridges. In certain embodiments, four (4) slots are configured to match a width of a .380 cartridge. In certain embodiments, more than 4 or fewer than 4 slots can be incorporated into the disk for different types of cartridges. In certain embodiments, slots in full-open configuration 16 match a width for a .308 cartridge.

A slot 11 (FIG. 4) defines an opening 19 (FIG. 9) on a top disk 50 (FIG. 5) and a grommet 18 (FIG. 6) on bottom disk 55 (FIG. 6), wherein a screw is employed to fixture the two disks together as one piece once the top disk 50 is rotated to a proper position to expand the slots into fully-closed configuration 10 to fit the length of the selected cartridge. In some embodiment, two slots 11 are sufficient. In certain embodiments, more or less slots 11 may be needed.

In certain embodiments, a nub 12 (FIG. 6) aligns cartridges properly to be disposed into a cassette 140 (FIG. 1B) and an attached magazine. Nub 12 can be positioned from about one to about twenty millimeters away from an inside wall of the bucket depending on the type of cartridges intended to be used in the machine.

In certain embodiments, nub 12 is formed to include member 17 extending upwardly from the disk, wherein member 17 is shaped as a rectangle with one flat side in line with the back of the slot or as a triangle shape with one of the flat sides in line with the back of the slot.

In certain embodiments, on an aspect of the nub 12 that faces into the slot, an outside corner, i.e., the corner that faces the slot and is closest to the inside wall of the bucket, is formed at a diagonal with no cut at the bottom of the nub 12 and the deepest part of the cut at the top of the nub 12. Further, the cut can be anywhere in between about 10 degrees off the Z/X plane to about 80 degrees off the Z/X plane. In the X/Y plane, the cut can also be angled anywhere in between about 10 to about 80 degrees off the plane.

In addition, in certain embodiments, the face that is created by said cut can be flat. In certain embodiments, the face can have a concaved, convex, or a combination thereof to manipulate the cartridges that are not aligned correctly to pass by nub 12 and out of the slot either in configuration 10 or configuration 16.

In certain embodiments, cartridges have a bullet tip that tapers toward the bullet center to facilitate travel of the bullet through the barrel of a gun, and to achieve favorable flight dynamics. Nub 12 lets each bullet tip pass by. Subsequently, the entire cartridge is moved out of the slot and falls into hopper funnel 130.

As a general matter, a cartridge is formed to include a large round flat back. In certain embodiments, the above rotatable disks 50 and 55 are configured to dispose nub 12 to create a space between the nub 12 and the bucket, wherein the space is small enough to prevent an entire cartridge, which is aligned correctly with its primer positioned against nub 12, to move through. Then, the cartridge is carried inside the plate slot either in configuration 10 or 16 up to slot 5 in the bucket. Subsequently, the cartridge falls out of hopper 110 and into hopper slide 130 by gravity.

Referring again to FIGS. 7 and 8, nub 12 seats fully against a disk portion 20 when the slot 16 is in full-open configuration. Both elements 17 and 20 facilitate cartridges, which have traveled past nub 12 and traveled up the ramp like part 17, to continue to travel to the bottom of hopper 110 without getting hung up on an edge. When the adjustable disks are configured either in configuration 10, 16, or at any intermediate point in between the edge of the top disk 50, the front part 22 of the slot is shaped in a way that does not interfere with the cartridge being able to fully seat into the slot.

In certain embodiments, a rectangular member 13 extends upwardly from the disk, and agitates the cartridges to ensure all cartridges can be aligned properly to fall into the slots in configuration 10 and to be caught by nub 12. In certain embodiments, two members 13 are sufficient. In certain embodiments, more or fewer members 13 are utilized.

In certain embodiments, an aperture 15 is formed on the top of the disk to permit a shaft of a motor 160 (FIG. 1C) to pass therethrough.

In certain embodiments, each of two apertures 14 includes a bump-up and a grommet, wherein the two apertures 14 are symmetrically placed on each side of aperture 15. A shaft of a motor connects to cover plate 9 through the bump-ups and grommets. In certain embodiments, aperture 14 can have a different configuration due to a slip-on and lock in place connector being incorporated onto the back of plate 9.

Figure 9:
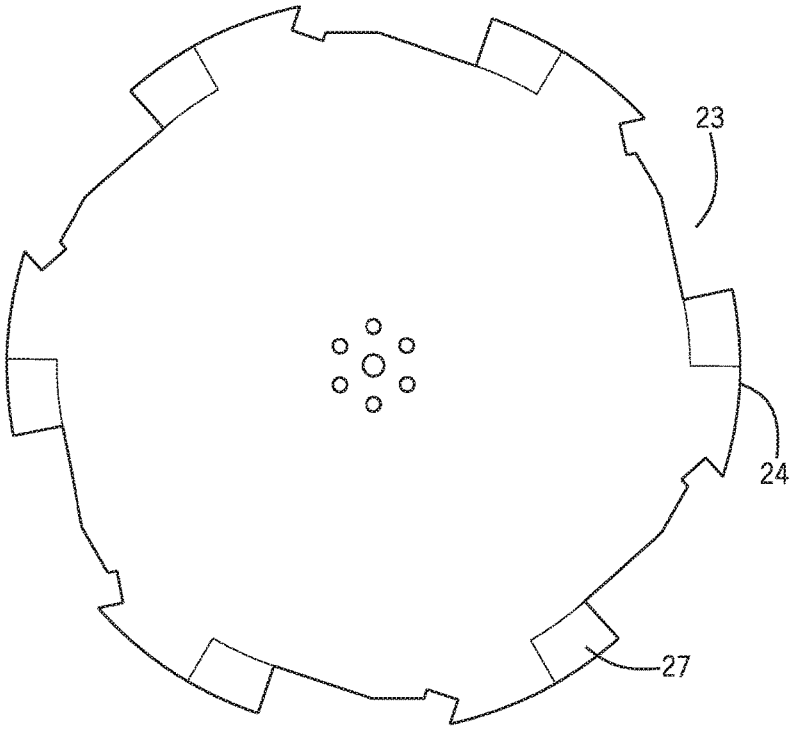
FIG. 9 illustrates a single-piece static slot disk version of the adjustable disk of FIGS. 4 and 5.

Referring to FIG. 9, in certain embodiments, the disk 6 can be constructed as a single piece with a static slot that is set with a specific gap to accommodate a specific caliber of ammunition or a small range of ammunition of roughly the same length. For example, a one-piece-static-slot disk 24 is configured to accommodate both 7.62×39 and .223 caliber ammunition.

In certain embodiments, a number of slots 23 is greater than 4, and is limited by a length of the cartridges to be loaded into the hopper 110. Further, the number of slots is further limited by the size of the hopper, and the room required for ramp 24 to manipulate the cartridges to fall back to the bottom of hopper 110. In certain embodiments, the one-piece disk can be constructed for nearly any caliber of ammunition from 22 Long Rifle or smaller up to 50 Cal or bigger without any restrictions.

Figure 10:
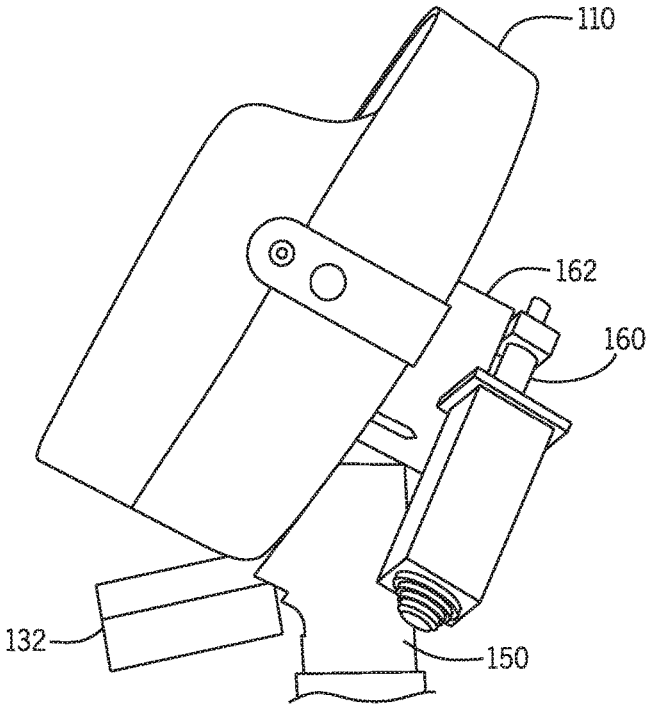
FIG. 10 is the side view of the hopper portion of FIG. 1B.

Referring to FIG. 10, in certain embodiments, hopper 110 is disposed on frame 150 at about a 60 degree angle from horizontal. In certain embodiments, hopper 110 and all of its associated parts are angled and configured such that they are at an angle from about 5 to about 90 degrees above horizontal. In certain embodiments, a drive motor 160 is an L-shaped gear motor.

The illustrated embodiment of FIG. 10 includes first motor 160 and first motor attachment 162 to rotating disk 6, and rectangular box 132 attached to the second end of funnel slide 130.

Hopper slide 130 acts as the connection point for the cassette 140 and the conduit for aligned cartridges to be moved from the slot 5 on the back of the hopper 110 to the cassette 140. In certain embodiments, hopper slide 130 comprises a tube. In certain embodiments, a bottom of hopper slide 130 is formed to include L shaped members that face inwardly on each side and mates with grooves formed on cassette 140.

In certain embodiments, on the back of the bucket inline with and directly behind the slot 5 at the top of the hopper 110, an L-shaped pipe/tube with a side facing the slot 5 cut open connects to the slot, through which the aligned cartridges fall into. Further, due to the combination of gravity and momentum, the aligned cartridge are directed via the L-shape down the back of hopper 110 through a tube or open faced slide that curves under hopper 110 and connects onto the back of hopper slide 130. In certain embodiments, many other ways of connecting and locking these said parts into place can be employed.

In certain embodiments, hopper slide 130 (FIG. 10) includes a rectangular shaped box, which is open on the bottom to allow the cartridges to fall through and into cassette 140 (FIG. 1B). Further, hopper slide 130 incorporates a bump-out part on the face that the cartridges impact once they have come to the end of the said slide, wherein this bump-out part limits cartridges from flipping up and becoming jammed in the cassette 140 by becoming misaligned.

Figure 11:
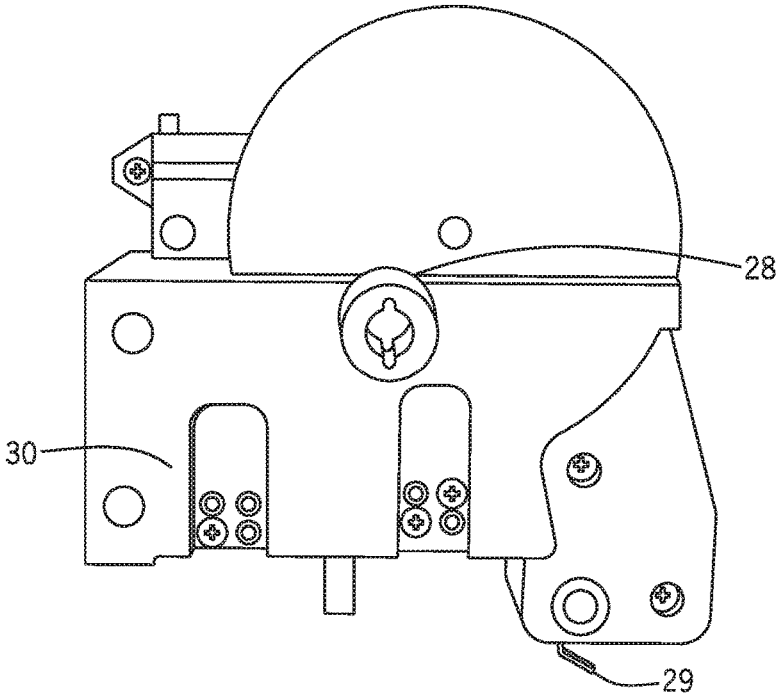
FIG. 11 illustrates the cassette portion that is used for an AK47 rifle magazine.

Referring to FIG. 11, cassette 140 (FIG. 1B) releasably attaches a firearm magazine, and pushes cartridges into that attached magazine. In certain embodiments, cassette 140 is operated by a hand crank 104 (FIG. 1A) In other embodiments, cassette 140 is operated by motor 170 (FIG. 1C).

Figure 14:
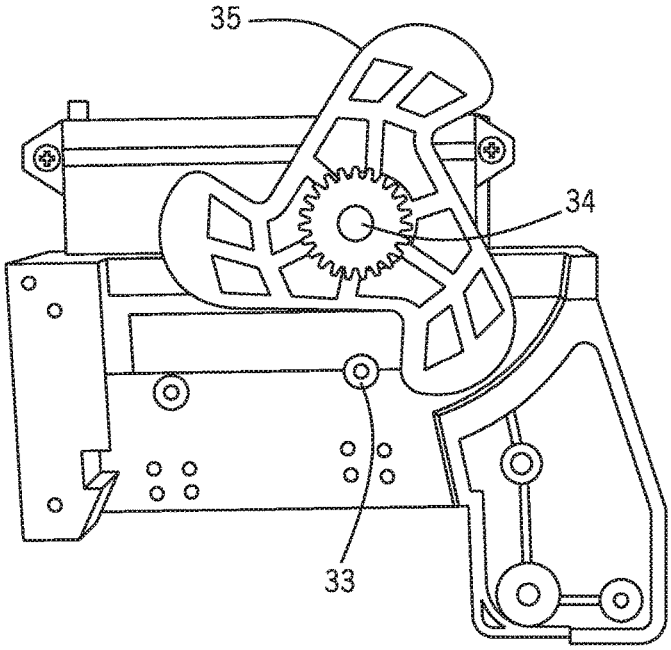
FIG. 14 shows the inside view of the cassette portion of FIG. 11.

In certain embodiments, an internal cam 35 (FIG. 14) pushes cartridges into a releasably attached magazine, and an interface part 28 (FIG. 11) connects a driving device and the internal cam.

Further, in certain embodiments interface part 28 is formed to include an indented and keyed socket, which can utilize hand crank 104 (FIG. 1A) to operate the cassette 140.

Figure 13:
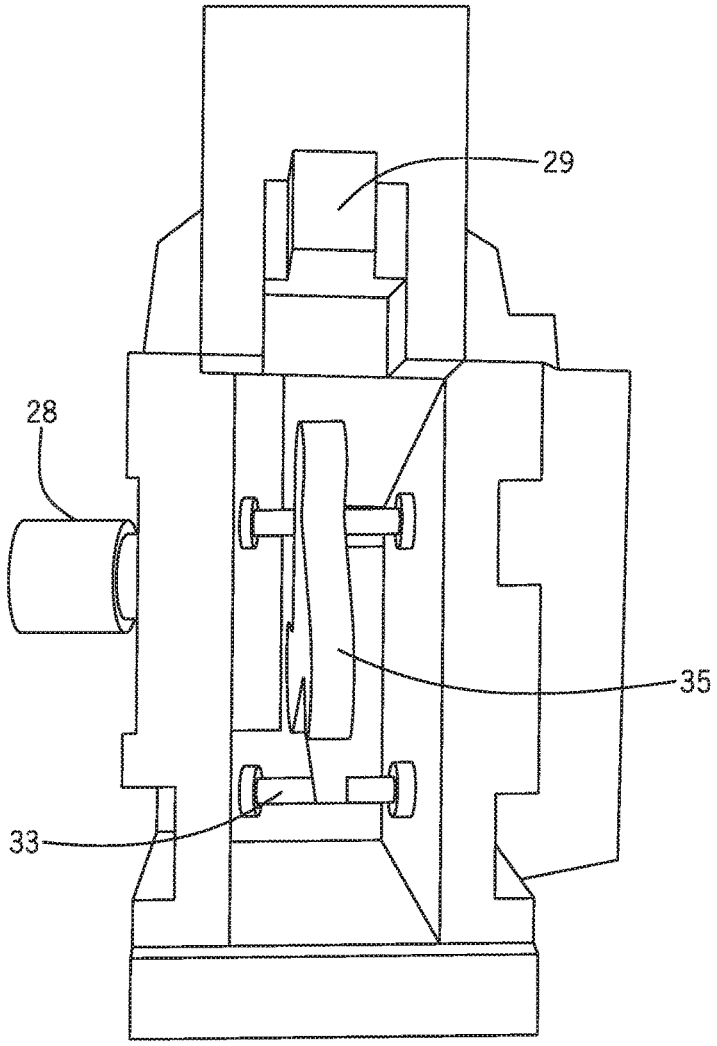
FIG. 13 shows a different view of the cassette portion from below.

Spring-loaded finger actuated clip 29 (FIG. 15) releasably fixtures a magazine. Four (4) small spring steal plates 30 (FIG. 11), two on each side of the cassette 140, are used to retain and allow retaining pins 33 (FIGS. 13, 14) to be move retaining pins from an extended orientation to a recessed orientation, i.e. to their starting position.

Referring again to FIG. 13, in certain embodiments retaining pins 33 are formed to include a collar that allows them to be retained in cassette 140 wall without falling completely out of the holes wherein they reside. Retaining pins 33 can move freely out of the wall when cam 35 is rotated to push cartridges down. Retaining pins 33 move back into the walls of the cassette 140 after a cartridge passes by. Then, retaining pins 33 are pushed back into place by spring steel plates 30, to be ready for a next cartridge to be held in place until cam 35 rotates again to push that next cartridge downwardly.

Figure 12:
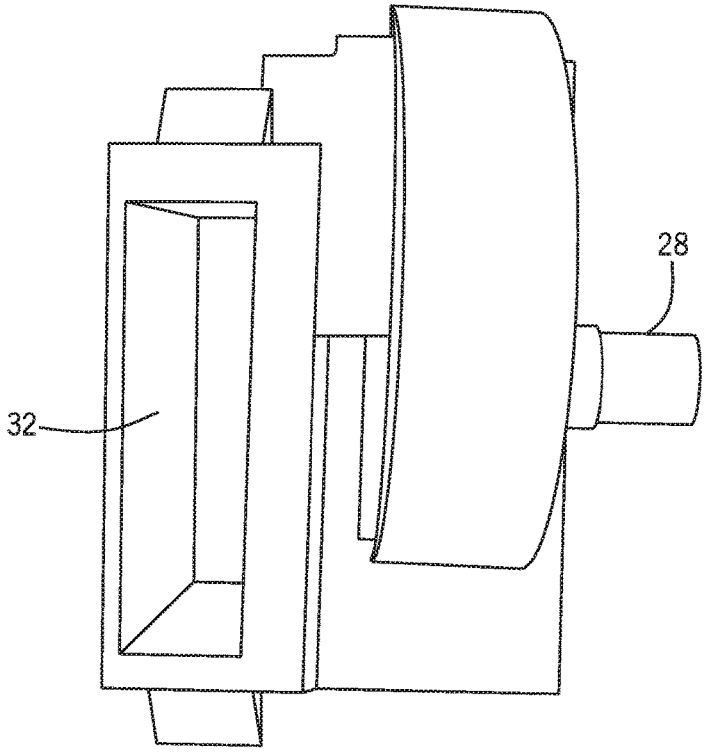
FIG. 12 is the top view of the cassette portion that is used for the AK47 rifle magazine.

Referring again to FIG. 12, slot 32 allows cartridges to enter cassette 140 (FIG. 1B) from hopper slide 130, when cassette 140 and hopper slide 130 are connected.

Referring again to FIG. 13, in certain embodiments, when no magazine is inserted in cassette 140, retaining pins 33 hold the cartridge in place and prevent that cartridge from falling out the bottom of cassette 140.

Referring again to FIG. 14, in certain embodiments, cassette 140 (FIG. 1B) has the front pins disposed slightly lower than the back ones. Further, a gear 34 interlocks with a corresponding gear that is connected to the above said external cam interface part 28.

Figure 15:
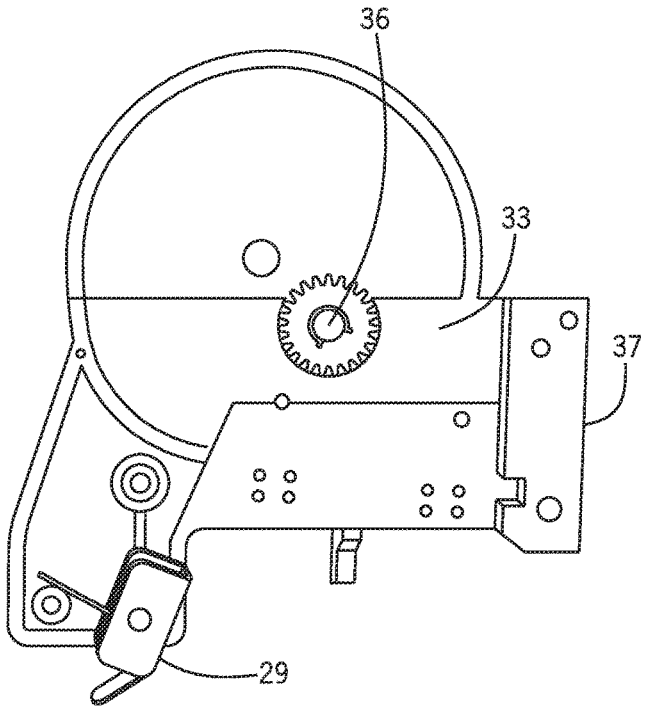
FIG. 15 illustrates the part of the cassette that mates up to the other half of the cassette of FIG. 14.

As a general matter; the gears are configured in a 1:1 gear ratio. In certain embodiments, other gear ratios are utilized in other cassette configurations. Referring to FIG. 15, a gear 36, which directly connects to interface device 28, interfaces with gear 34 (FIG. 14), which is directly connected to cam 35. Additionally in certain embodiments, cassette 140 includes alignment pins 37, which are used to align and strengthen the two parts of the cassette 140.

Figure 16:
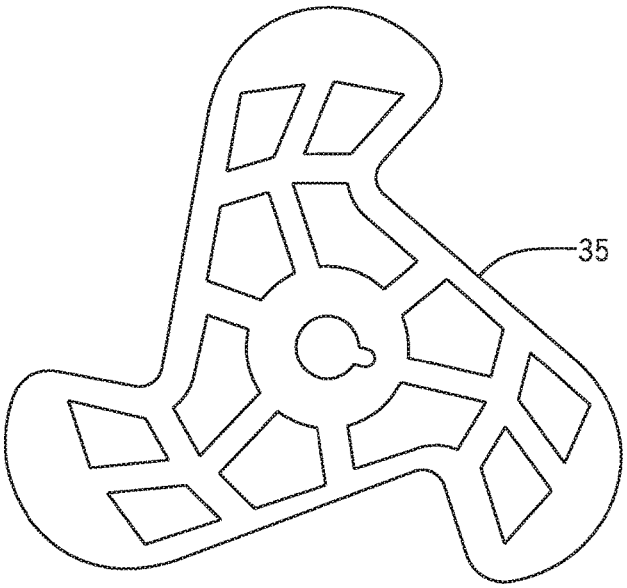
FIG. 16 shows the cam portion of FIG. 14.
Figure 17:
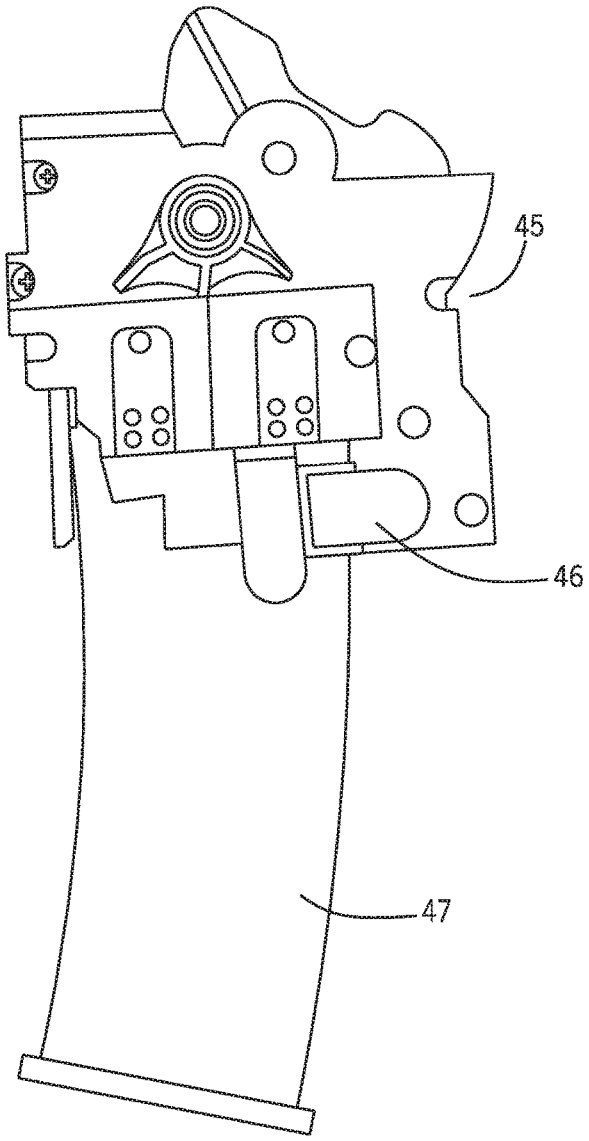
FIG. 17 illustrates a different type of cassette that is used for an AR15 magazine.

In the illustrated embodiment of FIG. 16, cam 35 comprises three lobes. In other embodiments, more than 3 lobes or fewer than 3 lobes are utilized. Further, cam 35 is formed to include a keyed hole to allow operation by a keyed shaft. In certain embodiments, cam 35 is configured for a 7.62×39 round, but can also be utilized for a .223 round. Further, the drive direction of cam 35 is counterclockwise, and a L-shaped cutout is utilized to allow the cartridges to fall into the cassette aligned atop the magazine.

In certain embodiments, with rifle magazines, cartridges are aligned directly above the magazine and are pushed directly down until the cartridges are disposed within the magazine. With pistol magazines, the cartridges are placed to be loaded half way forward toward the front of the magazine and then the back end of the cartridge are pushed down toward the back of the magazine until the said cartridges are seated.

Figure 18:
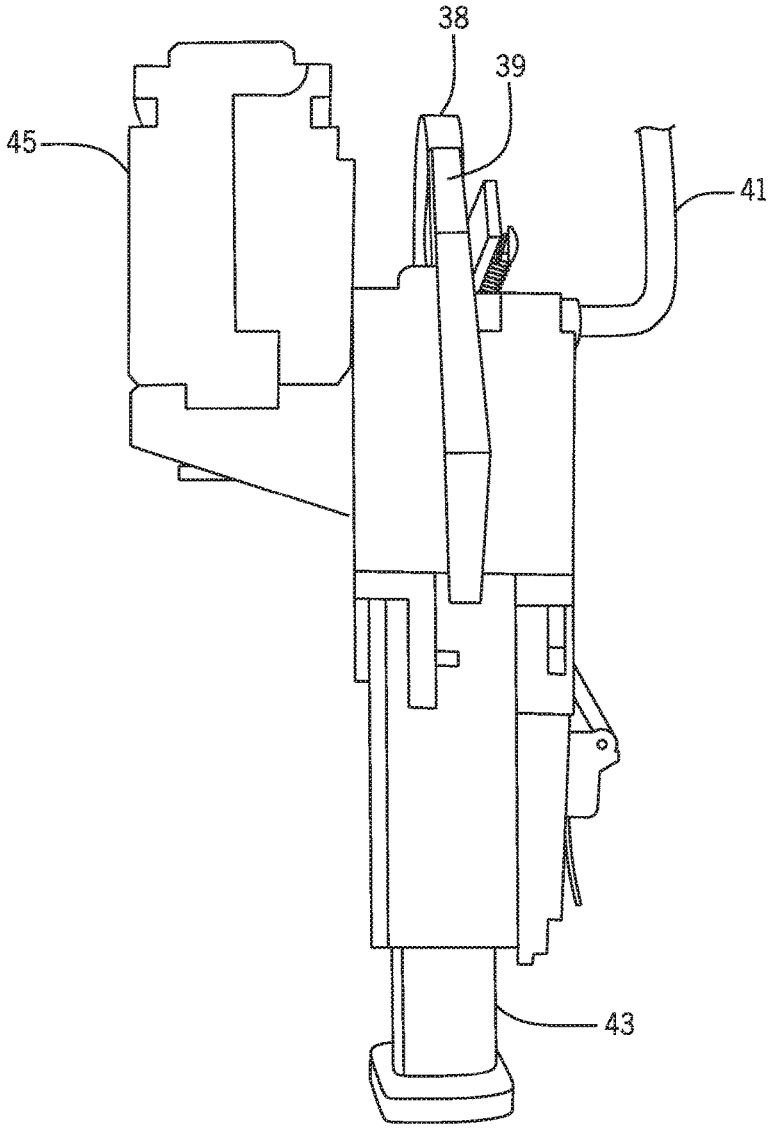
FIG. 18 shows a front view of another different type of cassette that is used for 40 caliber and 9 millimeter magazines.
Figure 19:
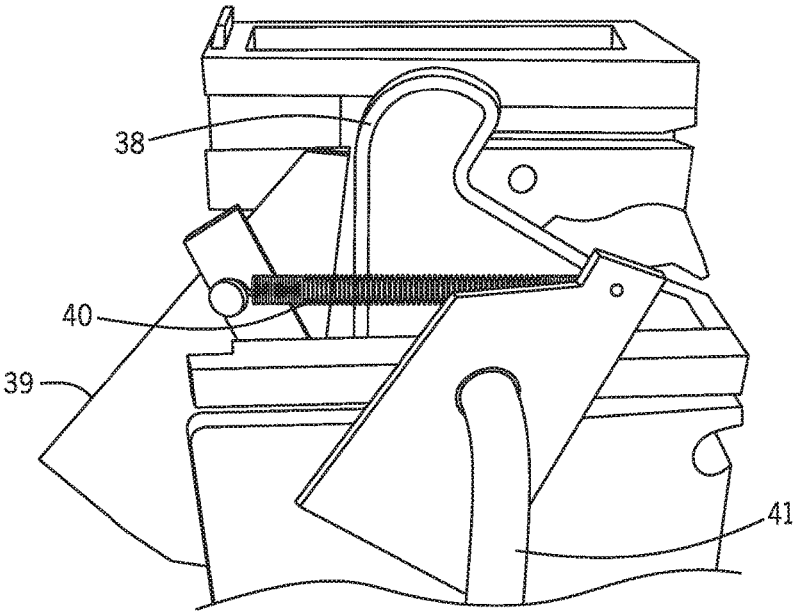
FIG. 19 is the side view of the cassette of FIG. 18.
Figure 20:
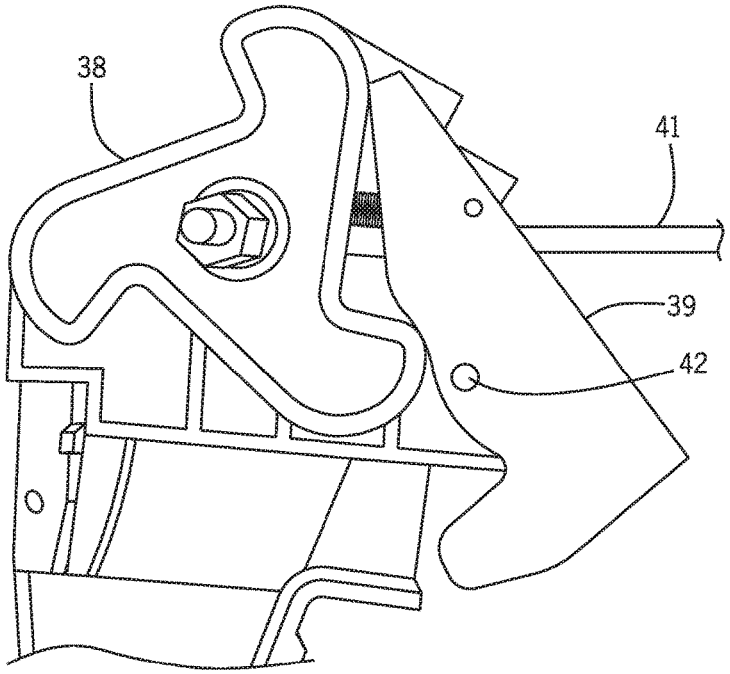
FIG. 20 is the inside view of the cassette of FIG. 18.
Figure 21:
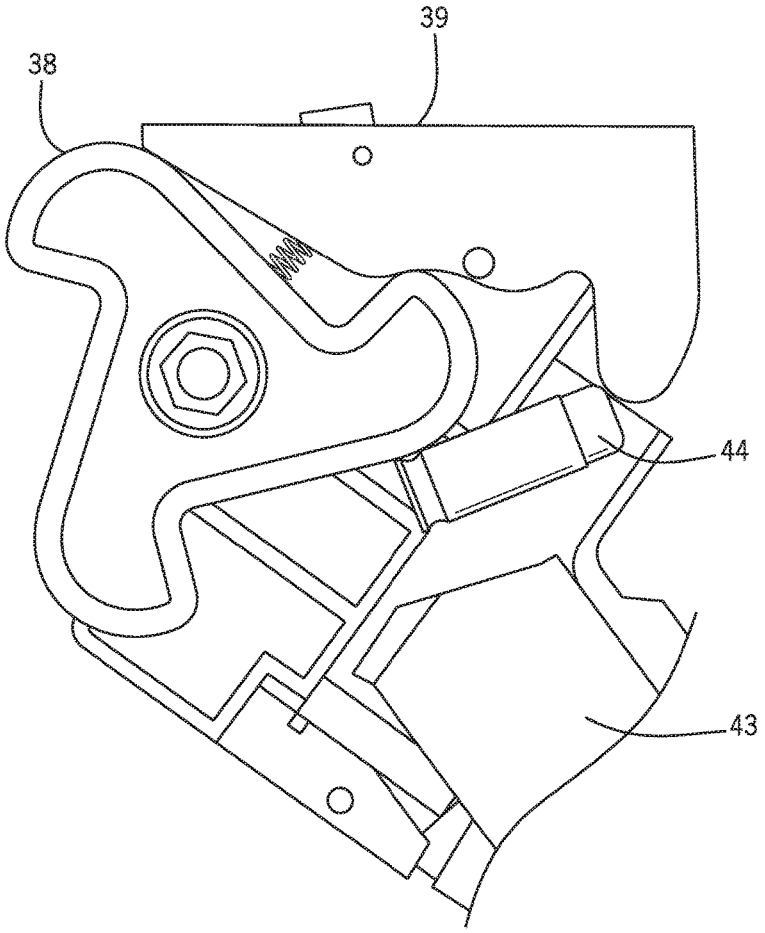
FIG. 21 shows a different perspective of the inside view of the cassette of FIG. 18.
Figure 22:
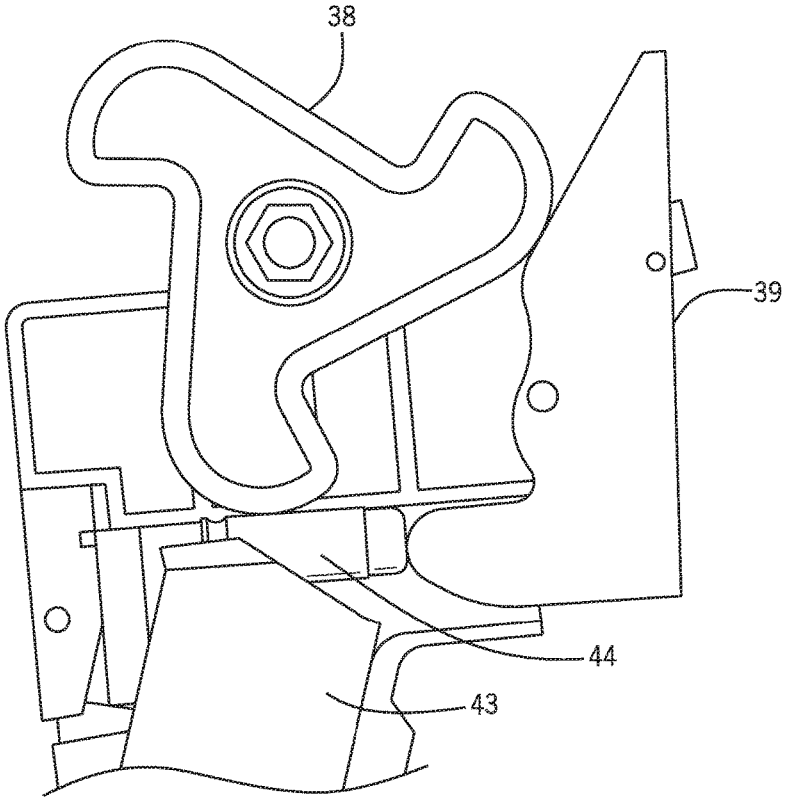
FIG. 22 illustrates a perspective view of the cassette of FIG. 11 pushing the cartridge down, with a point of the cam portion's rotation, the L-shape arm portion partially extended, and the cartridge under the lips of the magazine without fully seated.
Figure 23:
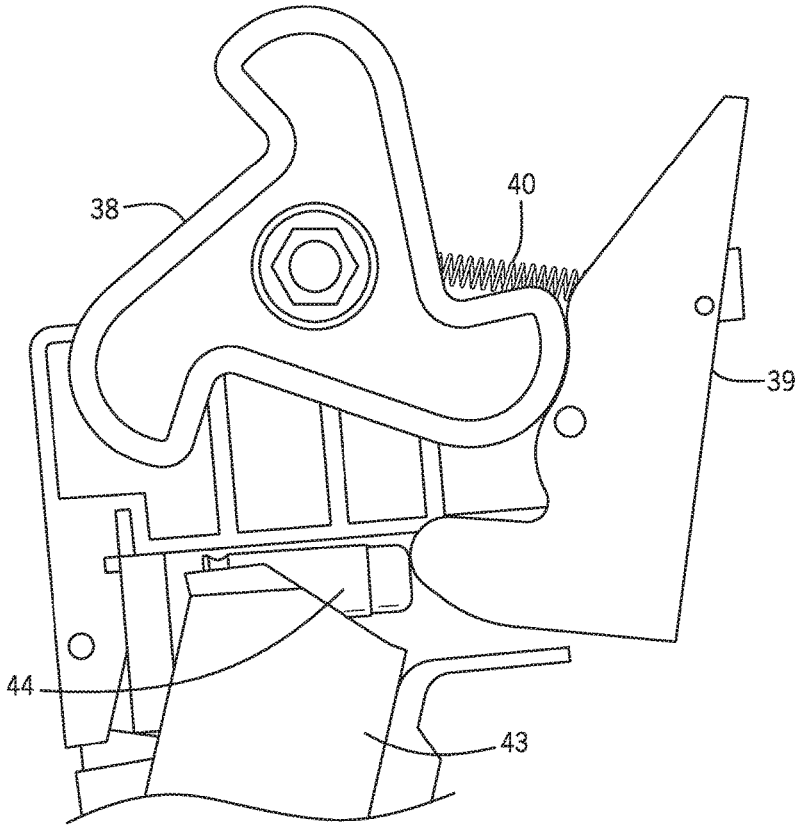
FIG. 23 shows a perspective view of the cassette of FIG. 18, where a cartridge is completely pushed into and seated in the magazine, with a point of the cam portion's rotation, the L-shape arm fully moved forward, and the retention spring portion fully extended.
Figure 24:
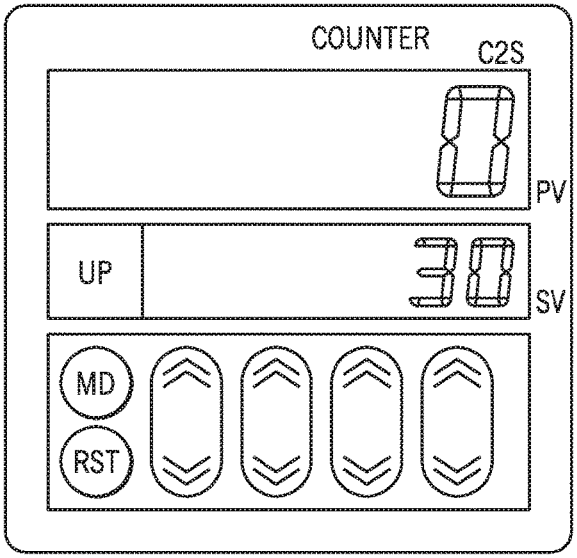
FIG. 24 is the front view of an counter for counting and monitoring the number of loaded rounds.

Referring to FIGS. 18, 19, 20, 21, 22, and 23, a L-shaped arm 39 (FIG. 19) pivots as cam 38 is rotated. When cam 38 pushes the back of the cartridge, one of the lobes of cam 38 contacts the top of arm 39. The contact continues to push forward the top of arm 39 to pivot around a point 42 (FIG. 20) on arm 39, and moves the bottom part of arm 39 to push against the front of the cartridge, which is then urged backwardly. Together with cam 38 pushing the back of the cartridge, the cartridge is pushed into magazine 43 (FIG. 21) and disposed in magazine 43 (FIG. 18).

In certain embodiments, micro-switches are installed in cassette 140 to detect the insertion of a magazine into the magazine well, and to detect the insertion of a cartridge into the magazine.

While the preferred embodiments of the present invention have been illustrated in detail, it should be apparent that modifications and adaptations to those embodiments may occur to one skilled in the art without departing from the scope of the present invention.

I claim:

1. An apparatus for loading cartridges into a firearm magazine, comprising:

a funnel;

a hopper slide having a first end and a second end; and a cassette to releasably fixture a firearm magazine to said apparatus wherein:

said first end of said hopper slide is attached to said funnel; and said second end of said hopper slide is attached to said cassette.

2. An apparatus for loading cartridges into a firearm magazine, comprising:

a hopper comprising a rotatable disk;

a hopper slide having a first end and a second end, wherein said first end is attached to said hopper; and a cassette attached to said second end of said hopper slide.

3. The apparatus of claim 2, wherein said hopper comprises a bucket, a rotatable disk, and a cover.

4. The apparatus of claim 3, further comprising a hand crank to rotate said disk.

5. The apparatus of claim 3, further comprising a first motor to rotate said disk.

6. The apparatus of claim 3, wherein said rotatable disk comprises one top disk and one bottom disk.

7. The apparatus of claim 3, wherein said rotatable disk comprises one disk formed to include a plurality of slots formed therethrough.

8. The apparatus of claim 2, wherein said hopper slide comprises a downward sloping slide or tube.

9. The apparatus of claim 8, wherein said second end of said hopper slide comprises an enclosure formed to include an aperture extending therethrough to allow cartridges to fall through and into said cassette.

10. The apparatus of claim 2, wherein said cassette comprises:

a cam for pushing cartridges into an attached magazine;

a spring-loaded clip for retaining said magazine;

a plurality of moveable retaining pins; and a plurality of spring steal plates for retaining and moving said retaining pins from an extended orientation to a recessed orientation.

11. The apparatus of claim 10, further comprising a hand crank to operate said cassette.

12. The apparatus of claim 10, further comprising a second motor to operate said cassette.

13. The apparatus of claim 10, wherein said cam comprises a plurality of lobes and an aperture that mates to a drive shaft.

14. The apparatus of claim 10, further comprising a controller comprising a processor, a non-transitory computer readable medium interconnected with said processor;

wherein said controller is in communication with said first motor and with second motor.

15. The apparatus of claim 3, wherein said disk comprises a nub for aligning cartridges properly to be disposed into said cassette.

16. The apparatus of claim 15, wherein said nub comprises a member extending upwardly from said disk.

17. The apparatus of claim 16, wherein said upwardly extending member comprises one flat side in line with the back of a slot formed in said cassette.

18. The apparatus of claim 15, wherein said nub is disposed about one millimeter to about twenty millimeters away from an inside wall of said bucket.

19. The apparatus of claim 15, wherein said nub further comprises an outside corner that faces said slot and is closest to the inside wall of said bucket.

20. The apparatus of claim 19, wherein said corner is formed at a diagonal with no cut at the bottom of said nub and the deepest part of the cut at the top of said nub.

* * * * *